United States Patent [19]

Thompson

[11] Patent Number: 4,760,679

[45] Date of Patent: Aug. 2, 1988

[54] ROOFING PANEL AND METHOD

[76] Inventor: Peter B. Thompson, Swiss Cottage, Nordrach, Blagdon Bristol BS186XW, England

[21] Appl. No.: 861,222

[22] Filed: May 8, 1986

[51] Int. Cl.[4] ..... E04B 5/00

[52] U.S. Cl. ..... 52/573; 52/408; 52/309.1; 52/630

[58] Field of Search ..... 52/309.13, 309.1, 408, 52/410, 573, 630, 573

[56] References Cited

U.S. PATENT DOCUMENTS

| | | | |
|---|---|---|---|
| 1,178,673 | 4/1916 | Plank | 52/630 |
| 1,244,806 | 10/1917 | Weisbrod | 52/630 |
| 1,410,945 | 3/1922 | Mayfield | 52/630 |
| 2,736,400 | 2/1956 | Gay | 52/573 |
| 2,876,927 | 3/1959 | Henning | 52/309.1 |
| 3,224,621 | 12/1965 | Upthegrove | 52/573 |
| 3,302,358 | 2/1967 | Jackson | 52/573 |
| 3,310,925 | 3/1967 | Brun | 52/573 |
| 3,525,661 | 8/1970 | Jackson | 52/408 |
| 3,994,693 | 11/1976 | Parmley | 52/573 |
| 4,009,917 | 3/1977 | Yonkers | 52/573 |
| 4,018,017 | 4/1977 | Schoop | 52/573 |
| 4,149,652 | 4/1979 | Osaka | 52/573 |
| 4,155,482 | 5/1979 | Swaney | 52/573 |
| 4,617,818 | 10/1986 | Fukuyori | 52/630 |

FOREIGN PATENT DOCUMENTS

| | | | |
|---|---|---|---|
| 1286588 | 1/1962 | France | 52/309.13 |
| 9738 | 5/1853 | United Kingdom | 52/630 |
| 177623 | 4/1922 | United Kingdom | 52/630 |
| 2115346 | 9/1983 | United Kingdom . | |

*Primary Examiner*—Henry E. Raduazo

*Attorney, Agent, or Firm*—Rines and Rines Shapiro and Shapiro

[57] ABSTRACT

Polyester resin glass fiber-reinforced similar planar panels and roofs formed therefrom incorporating as an integral portion of the panels one or more narrow ridges, including ridges disposed at angles to one another, for accommodating expansion or contraction relative to the substrate on which the same is laid.

7 Claims, 2 Drawing Sheets

ROOFING PANEL AND METHOD

This invention relates to a roofing panel, to a roof including a plurality of such panels and to a method of forming and of laying roofing panels to form a roof. The invention is particularly, but not exclusively, concerned with what are hereinafter referred to as flat roofs; that is, roofs which are horizontal or slope at a shallow angle, typically less than 15° to the horizontal.

In a roofing structure employing roofing panels of a substantially inextensible kind, and particularly as structure having a large area, there is a need to accommodate relative variations in the dimensions of the panels and the support structure on which they rest due for example to temperature changes.

One form of roofing deck for such roofs has been corrugated metal sheets which are laid across spaced apart supports. Between the supports the sheets are un-supported and the corrugations in the sheets impart the necessary structural strength to the sheet to enable it to span the supports. U.S. Pat. No. 3,310,925 describes an arrangement in which sheets are laid with their side edges overlapping and have corrugations which are referred to as expansion or contraction crimps. This arrangement might also be used in forming a roofing deck but would not seem suitable for use as a roofing panel as it would not be a simple matter to make it waterproof particularly at sites where four panels meet at their corners. In structures other than roofs it has also been proposed to provide metal panels with corrugations which accommodate dimensional variations in the panels.

In addition to the form of roofing panel described above, roofing panels are also known which are intended to be laid on a substantially continuous substrate. A roofing panel of this kind does not require significant structural strength and its purpose is to provide a waterproof skin to a roof. Commonly such panels are made of plastics material. The same need to accommodate relative dimensional variations between the panel and the supporting substrate arises with these panels and in this case there is the added difficulty that the plastics materials suitable for such panels, for example glass reinforced plastics material, are not as ductile as metal. Previous solutions to this problem have involved providing for the dimensional variation at the edges of adjacent panels by providing a special expansion joint between adjacent panels or by oversized fixing holes. An example of such a design is shown in GB No. 2,115,346.

According to the invention there is provided, in summary, a roofing panel suitable for use on a flat roof, the panel being of substantially lamellar form and being made of plastics material, wherein one or more ridges extending preferably across a major part of the width or length of the panel are provided as an integral part thereof for accommodating expansion or contraction of the panel relative to a substrate on which it is laid and transverse to the ridge or ridges.

The panel of the present invention incorporates as an integral part of the panel an arrangement for accommodating expansion or contraction of the panel relative to the substrate on which it is laid. Thus the need for separate expansion joints is eliminated and the construction of a roof simplified.

Preferably the panel is of rectangular shape, although other shapes such as hexagons or triangles could be used.

The one or more ridges may be positioned in a variety of ways on the panel. A ridge may be provided along the length of the panel approximately equidistant from the opposite sides thereof and/or a pair of ridges may be provided extending along the length of the panel and positioned along opposite sides of the centre of the panel. Alternatively, a ridge may be provided along one or both diagonals of the panel.

In addition or instead of ridges along the length of the panel, a ridge may be provided across the width of the panel approximately equidistant from the ends thereof and/or a pair of ridges extending across the width of the panel and positioned on opposite sides of a transverse centre line of the panel may be provided.

It may be advantageous to provide one or more ridges adjacent one or more edges of the panel since in that position the ridges can provide not only a means for accommodating expansion or contraction, but also a border to a seam formed between adjacent panels.

A ridge may simply comprise two walls steeply inclined to the plane of the panel body and joined together by a top wall parallel to the plane of the panel body—such comprising integral panel deformations out of said plane. The ridge may, however, include three or more walls steeply inclined to the plane of the panel body, such forms of ridges being described below with reference to the accompanying drawings. The greater number of steeply inclined walls that are provided in a ridge, the greater its capacity for accommodating expansion or contraction. Also, the closer the inclination of a wall is to the perpendicular and the taller the wall is, the greater its capacity for accommodating expansion or contraction.

Preferably, the one or more ridges project outside the plane of the panel body to one side only. The panel would normally be laid with that one side as the upper side. In such a case the panel can lie in contact with a supporting substrate over the whole or its surface apart from where the one or more ridges are provided.

The plastics material from which the panel is made is preferably a polyester resin material. Other suitable rigid or semi-rigid plastics materials could be used. The plastics material preferably incorporates reinforcement which may comprise fibres or strands and may be glass, polyester, nylon, polythene, metal or carbon.

It may be advantageous for the one or more ridges to be made of a plastics material different from the plastics material from which the panel body is made. For example, the ridges may be made of a more flexible material than the rest of the panel body. In such a case the one or more ridges would still be an integral part of the panel body.

Another object of the invention is to provide a roof including a plurality of panels, each as defined above, laid on a substrate, wherein the orientation of the panels is varied over the area of the roof such that any straight line coincident with a boundary line between adjacent panels intersects a panel having a ridge transverse to the given straight line.

By laying panels in the unconventional arrangement described above, it is ensured that even though a single panel may only be able to accommodate expansion or contraction in one direction, along any given line coincident with a boundary line between adjacent panels, there is always one panel able to accommodate expansion or contraction along that line.

According to a further object of the invention, there is provided a roof including a plurality of panels, each as defined above, laid on a substrate, in which the panels are rectangular and are laid with the ends of the panels adjacent the sides of other panels. Again, this unconventional arrangement for laying the panels enables expansion or contraction of the panels in any direction to be accommodated.

In a preferred embodiment of the invention, the length of each panel is about twice its width and panels oriented in the same way are laid alongside one another with the ends of the panels spaced apart from each other by the width of each panel and adjoining sides of panels that are orientated perpendicular thereto.

According to a further aspect of the invention, there is provided a roof including a plurality of panels laid on a substrate, each panel including means for accommodating expansion or contraction of the panel in a given direction, wherein the orientation of the panels is varied over the area of the roof such that any straight line coincident with a boundary line between adjacent panels is intersected by a panel that includes means for accommodating expansion or contraction in a direction transverse to the straight line.

According to yet another aspect of the invention, there is provided a method of laying panels on a substrate to form a roof in which each panel includes means for accommodating expansion or contraction of the panel in a given direction and the panels are laid with their orientation varying over the area of the roof such that any straight line coincident with a boundary line between adjacent panels is intersected by a panel that includes means for accommodating expansion or contraction in a direction transverse to the straight line.

By way of example, certain illustrative embodiments of the invention will now be described with reference to the accompanying drawings, of which:

Figure 1A:
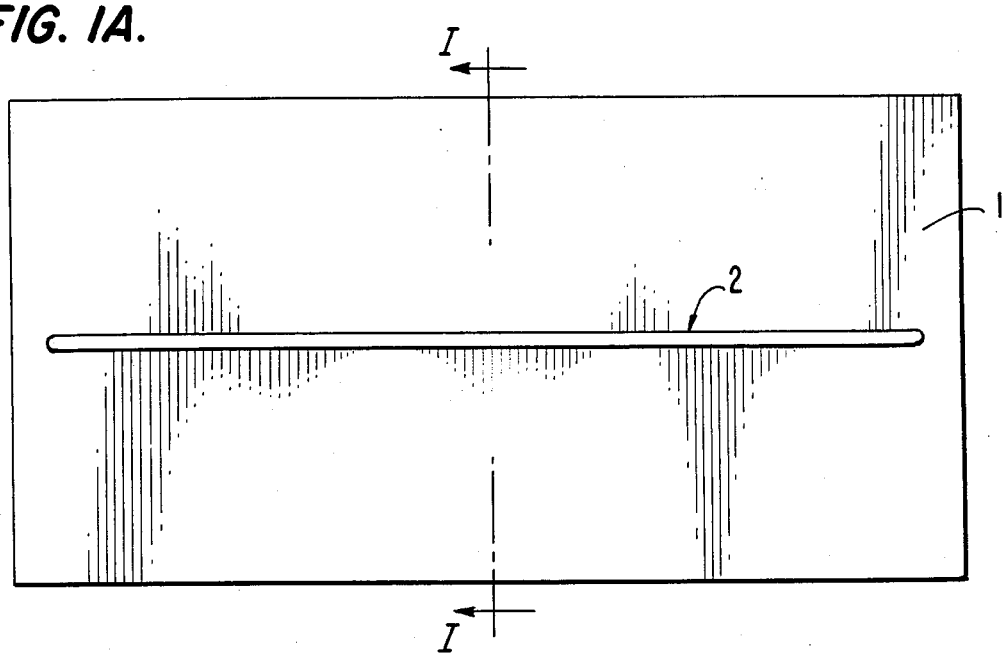
FIG. 1A is a plan view of a roof panel.
Figure 1B:
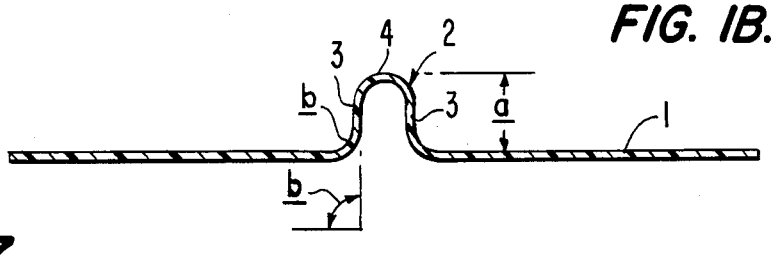
FIG. 1B is a sectional view along the line I—I in FIG. 1A of the panel.

Referring first to FIGS. 1A and 1B, the panel 1 shown is made in one piece of glass reinforced polyester (GRP), is of rectangular shape and is of generally lamellar form apart from a ridge 2 extending down the longitudinal centre line of the panel along substantially the whole length thereof. As can be seen in FIG. 1B the ridge 2 is formed from two steeply inclined walls 3 which merge into a curved top wall 4. The walls 3 are inclined at an angle b to the plane of the panel body (in this case b is about 90°) and the top of the ridge 2 is a height a above the plane of the panel body. In the case of the panel shown in FIG. 1, dimension a will be at least 1 cm, the narrow width of the ridge being shown comparable therewith. The ridge 2 terminates just before the edge of the panel 1 in order that the whole of the border of the panel should lie in a common plane so that it can be laid in contact with a flat substrate around the whole of its periphery.

In this example of the invention the panel 1 has a length which is twice its width and its length is 8 ft (2.44 m), as distinguished from the very narrow (order of centimeter(s)) ridge.

Figure 2:
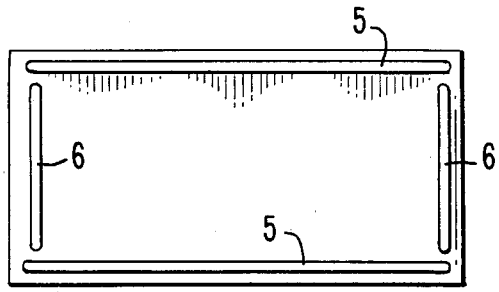
FIGS. 2 to 5, 6A and 6B illustrate schematically alternative forms of panel to that shown in FIG. 1A.

FIG. 2 shows an alternative form of panel having a pair of ridges 5 extending along the length of the panel and positioned on opposite sides of its longitudinal center line towards the opposite side edges of the panel, and a pair of ridges 6 extending across the width of the panel and positioned on opposite sides of its transverse center line towards the opposite ends of the panel. The ridges 5 and 6 terminate adjacent one another. It is advantageous that they do not join as this prevents pools of water from forming on the panel.

Figure 3:
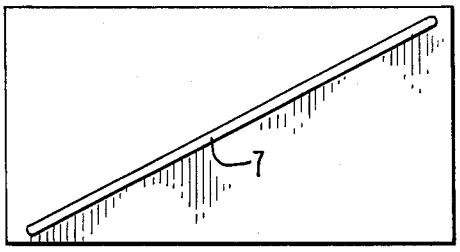

FIG. 3 shows an alternative form of panel having a single diagonal ridge 7.

Figure 4:
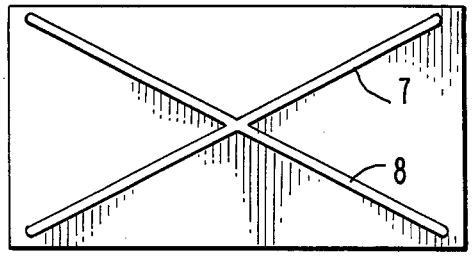

FIG. 4 shows an alternative form of panel having a pair of diagonal ridges 7, 8. In this illustrated embodiment the ridges 7, 8 intersect one another but, if desired, one or both ridges may have a discontinuity at the center of the panel so that pools of rain water will not form on the panel.

Figure 5:
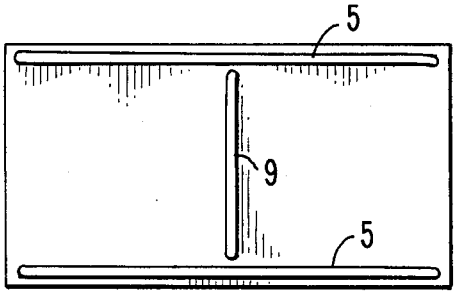

FIG. 5 shows an alternative form of panel having a pair of longitudinal ridges 5 as in FIG. 2 and a single transverse ridge 9 across the center of the panel between the ridges 5.

Figure 6A:
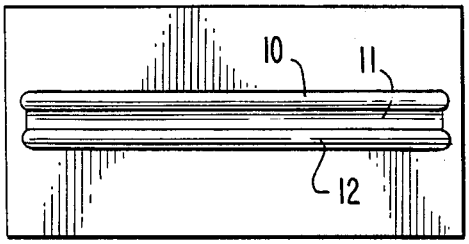
Figure 6B:
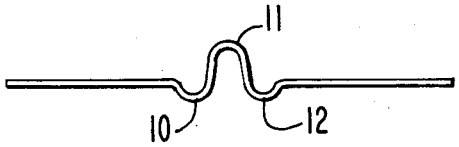

FIGS. 6A and 6B illustrate a panel broadly similar to the panel 1 of FIG. 1 but with a different form of ridge. In this case the ridge is shown as made up of three separate portions 10, 11 and 12 formed between four steeply inclined wall portions. While in the illustrated embodiment the portions 10 and 12 project to one side of the panel body while the portion 11 projects to the other side, it will be understood that a ridge could also be made up from a number of portions all projecting on one side of the panel body thereby enabling the other side of the panel body to be laid on a flat substrate.

It should be understood that the ridge or deformation configurations described above are examples only and other configurations, including other combinations of the illustrated configurations, could be employed, all herein being referred to as "ridges".

Figure 7:
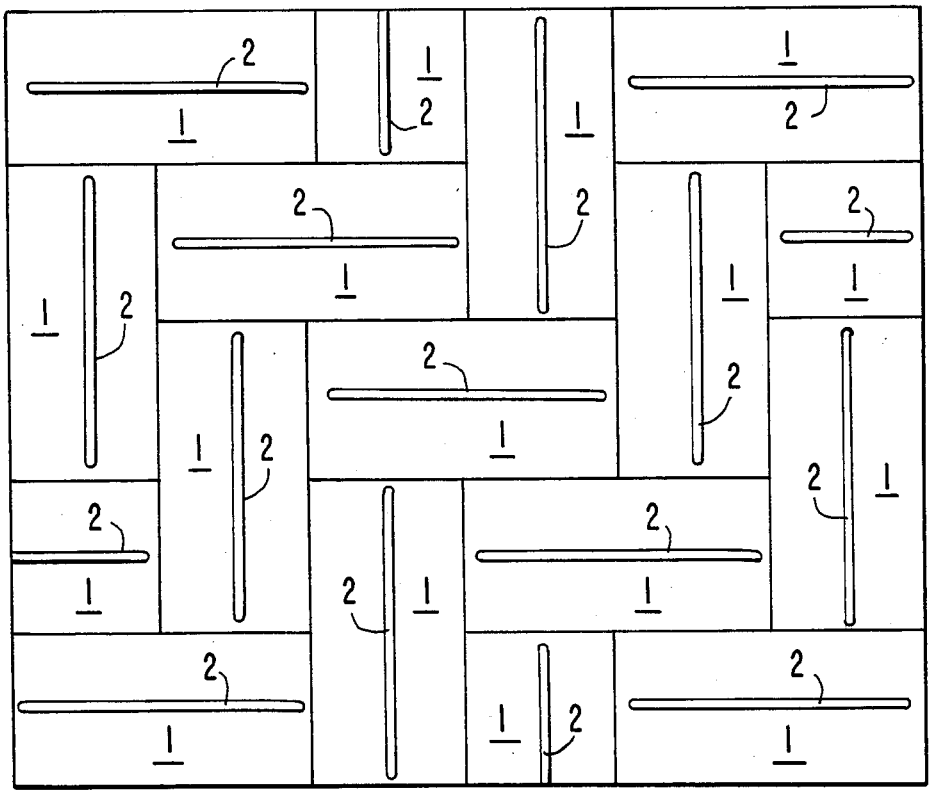
FIG. 7 is a diagrammatic view of a roof structure made up of a plurality of panels of the form shown in FIG. 1A and illustrates a preferred pattern of laying of the panels of FIG. 1A.

FIG. 7 shows a preferred pattern in which the panels 1 of FIGS. 1A and 1B may be laid. It will be seen that half the panels are laid in one orientation and half in a perpendicular orientation and that adjacent panels orientated in the same way are arranged with their ends spaced apart from each other by the width of a panel, which is half the length of a panel. All the panels are laid with their ridges 2 uppermost.

It will be understood that in order to form a roof of rectangular configuration a number of half size panels are required around the edges of the roof. Suitable edging pieces will also be required and these may include one or more expansion ridges running at right angles to the roof edge line.

The panels 1 are laid contiguously on a continuous flat substrate (not shown), which may be the deck material or an insulation board or other suitable even surface, and are secured at their edges to the substrate or to deck material beneath the substrate by any suitable means which may comprise nails, screws, drill-screws, cavity or plug fastenings, spring or flexible fastenings or adhesives of various types.

If a panel 1 tends to expand or contract relative to the substrate on which it is laid, for example as a result of a change in temperature, then any such expansion or contraction forces exerted across the width of the panel are absorbed by deformation of the ridge 2 in the panel. Expansion or contraction along the length of the panel is not accommodated by the ridge 2 in that panel (in the case of the panel of FIGS. 1A and 1B), however, and has to be accommodated by slight movement in the fastening to the substrate or in the substrate itself. In practice it is found that the movement required to allow for such expansion and contraction of a single panel is small and can be accommodated but that the combined total expansion or contraction of a row of panels laid end to end requires a much greater movement of the ends of the row of panels which cannot be accommodated. However, by adopting the pattern of laying shown in FIG. 7, a ridge 2 is provided every one and a half panel lengths in both perpendicular or othogonal directions along the roof and thus the movement required to be accommodated in the fastening of the panel edge to the substrate is kept to a small amount that can be tolerated. Also the length of any one straight joint between panels is limited to one and a half panel lengths.

While the pattern of laying shown in FIG. 7 has been described with particular reference to the panels shown in FIGS. 1A and 1B, it should be understood that any of the panels shown in FIGS. 2 to 5, 6A and 6B may also be laid in this way. Although the panel shown in FIG. 2 for example is provided with both transverse and longitudinal ridges, it may still be advantageous to lay the panels in the pattern shown in FIG. 7.

While the present invention obviates the need for expansion joints in typical cases, it is within the scope of the invention to use the panels of the invention in conjunction with expansion joints. This may be useful if unusually large movements are to be accommodated, for example where two separate buildings or roofing decks are joined.

Some particular examples of methods of making and laying the panels will now be given in Examples 1 to 5 below.

EXAMPLE 1

Using a suitable male mould to the pattern required, the mould is covered with liquid polyester resin, for example that sold by Cray Valley Products under the trademark SYNOLAC, suitably catalyzed, by means of a brush, pouring or spraying or other convenient method. The catalyzed resin is overlaid, before it has cured, with a reinforcing layer and this sequence is repeated as necessary before or after previous layers are fully cured to build the required thickness of panel. The surface to be exposed directly to the weather will normally be finally coated with a gel-coat or colour coat to give improved surface finish and/or resistance to exposure to weather and light. If in this example a female mould were used to form the panels, the sequence of coatings would be reversed. The panels so formed should then be suitably cured either at room temperature or at an elevated temperature.

Panels will then be laid as shown in FIG. 7 on a substrate edge to edge, either overlapping, edges butting or with strips of any suitable material under the joints to improve joint smoothness or rigidity. Dependent upon weather conditions, mastic may be used to temporarily seal edges (seams) before the final seaming operation.

Next the panel edges are fastened to the substrate by one of the methods described above. Such fastening should be of a type and number sufficient to withstand wind uplift requirements.

The seams are then coated with liquid polyester resin, suitably catalyzed, and then reinforced with suitable fibre. This sequence may be repeated as necessary to achieve a suitable laminate.

Before the lamination is carried out, surfaces to be seamed may be roughened or cleaned with a suitable solvent so as to improve or facilitate good intercoat adhesion.

Finally a layer of clear or colour pigmented polyester gel-coat may be applied to the seams and/or the panels.

EXAMPLE 2

Using a suitable mould to the pattern required, a liquid compound including the suitably catalyzed polyester resin and chopped glass fibres providing inbuilt reinforcement, is coated on the mould surface. When partially cured or when cured or hardened, further layers of such reinforcement-containing liquid compound may be further overcoated.

Panels so formed will then be suitably cured and fixed to a roof substrate as described in Example 1.

EXAMPLE 3

A suitable quantity of mix containing catalyzed polyester resin, reinforcement fibres and a percentage of inert filler in a sheet form, known in the industry as SMC (sheet moulding compound) may be placed in a suitable male/female mould and subjected to high pressure and with heat applied for a suitable time.

Panels so formed will then be suitably fixed to a roof substrate in combination as described in Example 1.

EXAMPLE 4

A suitable quantity of mix containing catalyzed polyester resin, reinforcement fibres and inert filler, known in the industry as DMC (dough moulding compound) is placed in a suitable male/female mould and subjected to high pressure and with heat applied for a suitable time.

Panels so formed will then be suitably fixed to a roof substrate in combination as described in Example 1.

EXAMPLE 5

A panel formed as in Examples 1 to 4 is overcoated with a layer of flexible polyisocyanurate resin to provide additional surface protection. Such coating may be applied by spray, brush or roller. Some examples of alternative overcoatings are rigid polyisocyanurate resins, acrylates and silicone rubbers.

While in the examples described the panel seams are coated with polyester resins and suitable reinforcement, mastic material may be used instead of or in addition to the polyester resin.

Further modifications will occur to those skilled in this art, such being considered to fall within the spirit and scope of the invention as defined in the appended claims.

I claim:

1. A roofing panel suitable for use on a flat roof, the panel being a body of substantially lamellar form and being made of plastics material, wherein one or more ridges made of plastics material different from that of the panel body are provided inwardly of the periphery of the panel and extend across a major part of the width or length of the panel as an integral part of the panel for accommodating expansion or contraction of the panel relative to a substrate on which it is laid and transverse to the ridge or ridges, each ridge terminating at two free lengthwise ends short of edges of the panel such that the periphery of the panel lies substantially in a single plane, each ridge being disposed such that the panel is devoid of any substantial, fully ridge-enclosed area.

2. In combination with a flat roof having a substantially continuous flat roofing substrate which extends over the area of the roof, a waterproof skin comprising a plurality of lamellar planar panels formed of plastic and laid substantially contiguously upon said substrate so as to cover said substrate, each panel being bounded about its entire periphery by flat marginal panel portions which are secured to said substrate, each panel also having at least one integral narrow ridge deformed out of the plane of the panel and extending across a major portion of the panel but terminating at free longitudinal ends intermediate the secured flat marginal panel portions, said ridge having two longitudinal sidewalls inclined at steep angles to the plane of the panel and imparting to said ridge a substantial capacity to expand and contract transversely to absorb expansion and contraction forces on the panel transverse to said ridge, each panel further being devoid of any substantial, fully ridge-enclosed area.

3. The combination of claim 2, wherein each said panel is rectangular with length and width of the order of meters and said ridge of each panel has a width of the order of centimeters.

4. The combination of claim 2, wherein the inclination of said sidewalls of said ridge is about 90°.

5. The combination of claim 4, wherein the height of said ridge is of the order of centimeters.

6. The combination of claim 2, wherein the orientation of the panels is varied over the area of the roof such that any straight line coincident with a boundary line between adjacent panels intersects a panel having a ridge transverse to said straight line.

7. The combination of claim 2, wherein said plastic is reinforced polyester resin.

* * * * *